United States Patent [19]

Moore

[11] Patent Number: 4,777,678

[45] Date of Patent: Oct. 18, 1988

[54] METHOD AND APPARATUS FOR PROVIDING BACK SUPPORT

[75] Inventor: Gene M. Moore, St. Paul, Minn.

[73] Assignee: The Better Back Care Corporation, St. Paul, Minn.

[21] Appl. No.: 877,030

[22] Filed: Jun. 18, 1986

[51] Int. Cl.[4] ..... A47C 20/08

[52] U.S. Cl. ..... 5/431; 5/446; 5/465; 128/69; 128/76 R

[58] Field of Search ..... 128/68, 76 R, 69, 70; 5/465, 431, 430, 446; 269/328

[56] References Cited

U.S. PATENT DOCUMENTS

| | | | |
|---|---|---|---|
| 3,775,785 | 12/1973 | Mittendorf | 5/465 X |
| 3,828,377 | 8/1974 | Fary, Sr. | 128/76 R X |
| 4,171,549 | 10/1979 | Morrell et al. | 5/465 |
| 4,432,107 | 2/1984 | Clark et al, | 5/436 |
| 4,471,952 | 9/1984 | Spann | 269/328 |
| 4,473,913 | 10/1984 | Yluisaker | 5/465 X |
| 4,482,138 | 11/1984 | Spann | 269/328 |
| 4,518,203 | 5/1985 | White | 5/465 X |

FOREIGN PATENT DOCUMENTS

| | | | |
|---|---|---|---|
| 12663 | 9/1912 | United Kingdom | 128/68 |

OTHER PUBLICATIONS

Orthopedic Systems, Inc., Brochure (2 pages).
Commander-Omni Company, Inc., Information Sheet, (7 pages).
Physio Care Brochure, (3 pages).
Meda Plast Healthcare Brochure, (5 pages).
Span+Aids* Information Sheet, (2 pages)-American Hospital Supply Corporation.
Alimed, Inc., Catalog Excert at p. 35, (2 pages).
Mor-Loc Corporation Materials at p. 20, (2 pages).
Professional Product Research, Inc., Information Sheet, (1 page).
Posture Support Mfg., Inc., Information Sheet, (1 page).
Graham-Field Information Sheet, Identified as pp. 59 and 60, (2 pages).
1986 Catalog From Comfortably Yours, (7 pages), at p. 14 C, D and E; 15 I; 16 B and D; p. 20 B; p. 34 A and E; and p. 35J.
1986 Catalog From Solutions, (6 pages), at pp. 16, 34, 35, 44 and 45.
Bedrooms Advertising Sheet, (1 page).

*Primary Examiner*—Edgar S. Burr
*Assistant Examiner*—Moshe I. Cohen
*Attorney, Agent, or Firm*—Merchant, Gould, Smith, Edell, Welter & Schmidt

[57] ABSTRACT

The invention is directed to a method and apparatus for providing orthopedic support. A preferred system (20) includes a pair of wedge-shaped pillows (22, 24), a cervical pillow (32) and a rectangular elevation pillow (38). The pillows (22, 24, 32 and 38) can be made of polyurethane foam and covered with nylon. One of the wedge-shaped pillows 22 has a cross-section of a right isosceles triangle. The other wedge-shaped pillow (24) also has a cross-section substantially similar to a right isosceles triangle but has a concave portion (30) suitable for receiving a convex neck support area (36) of the cervical pillow (32). The pillows (22, 24, 32 and 38) preferably include Velcro TM strips which allow the pillows to be interconnected and connected to a mat (42) so that an individual's legs and head can be appropriately supported to induce a pain-reducing curve in the individual's lower back. Rings (22*a,b* and 24*a,b*) are attached to the sides (26*d,e* and 28*d,e*) of pillows (22 and 24). Velcro TM covered straps 46 adjustably interconnect the rings to allow for various adjustable arrangements of the pillows. When the pillows (22, 24, 32 and 38) are not in use to provide orthopedic support, they can be combined to form a geometric solid, e.g. a cube. Thus, they can be readily stored and transported in a compact solid shape, and can also be used as a small chair, stool or ottoman.

8 Claims, 4 Drawing Sheets

28e
28c
28a
24
28d
28b
30

34f
34d
36
34b
34c
32
34e
34a 40b
38
40f
40c
40a
40d
40e
f

METHOD AND APPARATUS FOR PROVIDING BACK SUPPORT

FIELD OF THE INVENTION

The invention generally relates to orthopedic devices and more particularly to methods and apparatus for providing back and neck support.

BACKGROUND OF THE INVENTION

Back problems are very common afflictions, and back ailments are becoming even more pervasive due to contemporary sedentary lifestyles. Some back problems can be permanently eliminated through surgery. Most back trouble, however, cannot be completely cured in the sense of permanently eradicating the cause of the problem. Back problems are thus usually chronic diseases that tend to persist for years, even decades.

In addition to surgery, there are several back treatment techniques. Exercise can eliminate or at least control many back problems. Weight loss can also mitigate many back problems. More serious back problems can be treated by a chiropractor, using standard adjustment techniques. In addition to periodic adjustment, a chiropractor may prescribe various orthopedic devices, including back and neck braces and back and neck pillows. Braces are typically strapped to a patient and are for use by an upright individual during the normal course of his day. The present invention is related to the latter technique, i.e., back and neck pillows. Such pillows are used to apply beneficial pressure to the neck and back of a reclining individual. The term "pillow" will be used throughout to refer to any resilient member suitable for providing support to the neck, legs and/or back. The term "pillows" therefore encompasses, but is not limited to, conventional bed pillows.

The prior art includes various cervical (neck), back and leg pillows. Cervical pillows are typically small foam items which are designed to support the head and neck of a prone individual to minimize neck and back pain. Reference is made to U.S. Pat. No. 4,432,107, issued to Clark et al, which discloses a small cervical pillow formed from a unitary body of resilient material, e.g., foam.

Cervical pillows are often used alone, but are sometimes used in conjunction with leg or back pillows. Leg/back pillows are typically pieces of foam or the like which are designed to raise the legs of a reclining individual to flatten the lumbar region of the spine. This reduces objectionable pressure and can reduce pain associated with various back maladies.

The technique of using individual and independent neck and leg/back support pillows possesses several shortcomings. One major shortcoming stems from the myriad individual needs and characteristics of the patients. Larger patients tend to need fairly large pillows to achieve a particular beneficial effect. Conversely, smaller patients generally need smaller pillows. Thus, successful orthopedic pillow manufacturers must supply a large variety of pillow sizes and shapes, and as a result cannot enjoy the benefits associated with mass production. From the consumer's standpoint, the large number of sizes and shapes of neck and leg/back pillows creates confusion and also probably prevents more than one family member from using a particular "custom" set of neck/leg/back support pillows.

Another perceived problem associated with prior art neck and leg/back support pillows is that they are difficult to store and transport. Some people need several different cervical and leg/back pillows; storage and transportation of several individual pillows can be inconvenient and esthetically unpleasing.

Still another problem associated with prior art orthopedic pillows is that they are non-adjustable. Therefore, as a patient's condition progresses, he might be forced to buy several sets of pillows to achieve the proper effect. And, the unadjustability of prior art pillows limits their use to only one person per family unit.

Finally, individual orthopedic pillows can slide about during use and thereby become ineffective. For example, if someone is using a cervical pillow and a leg support pillow, the pillows can, in time, slide apart so that the individual's legs, back and neck are no longer hroperly supported.

The present invention, described below, addresses the shortcomings of the prior art back and neck support pillows.

SUMMARY OF THE INVENTION

Accordingly, one embodiment of the present invention is broadly directed to an apparatus for providing back support, including: (a) a first pillow; (b) a second pillow; and (c) means for adjustably interconnecting the pillows, whereby the pillows can provide back support in a variety of ways.

Another embodiment is directed toward an apparatus for providing back support, including: (a) a first pillow; and (b) a second pillow, wherein the pillows are configured to combine to form a geometrical solid when not in use.

A more specific embodiment including many of the features of the present invention includes: (a) a cervical pillow; (b) a first wedge-shaped pillow; (c) a second wedge-shaped pillow; (d) a mat; and (e) adjustable means for connecting the cervical and first and second wedge-shaped pillows to the mat, wherein the cervical pillow can support the individual's neck and head and the first and second wedge-shaped pillows can be adjustably interconnected to support the individual's upper and lower legs in a variety of ways. The connecting means listed above preferably includes hook and loop connectors, an example of which are Velcro TM strips.

Also, the cervical pillow and the wedge-shaped pillows preferably combine to form a geometrical solid for storage and transportation when they are not being used to support the individual's back, legs and neck. The geometrical solid is a cube in a preferred embodiment.

A rectangular or parallelepiped elevation pillow can be included to elevate at least one of the wedge-shaped pillows to accommodate a large individual or to simply raise one of the wedge-shaped pillows such that it can be used as a back and head support in certain circumstances.

The wedge-shaped pillows preferably have cross sections which resemble right isosceles triangles. The pillows can be made of foam, e.g., polyurethane foam. The foam can be covered with any material, one type of contemplated covering being nylon.

The invention also includes a method for providing orthopedic support to an individual, including the steps of: (a) placing at least one pillow under the individual's legs; (b) placing at least one pillow under the individual's neck and head; and (c) adjustably interconnecting the pillows so that they can be configured in various ways to support the individual in an orthopedically sound fashion and so that the pillows cannot slide away from one another when positioned and interconnected together.

BRIEF DESCRIPTION OF THE DRAWING

The invention is further explained with reference to the Drawing which depicts preferred embodiments of the invention, and in which.

DETAILED DESCRIPTION OF PREFERRED EMBODIMENTS

Figure 1:
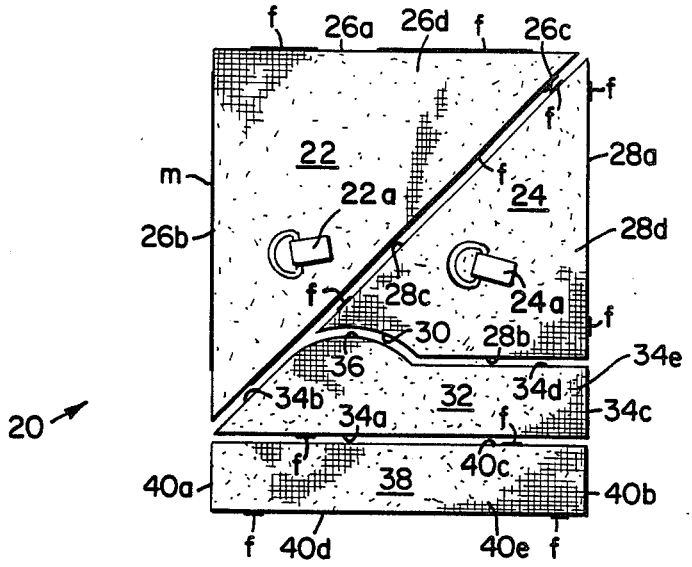
FIG. 1 is an elevational view of a back and neck support system according to the invention including four resilient support elements (pillows)
Figure 2:
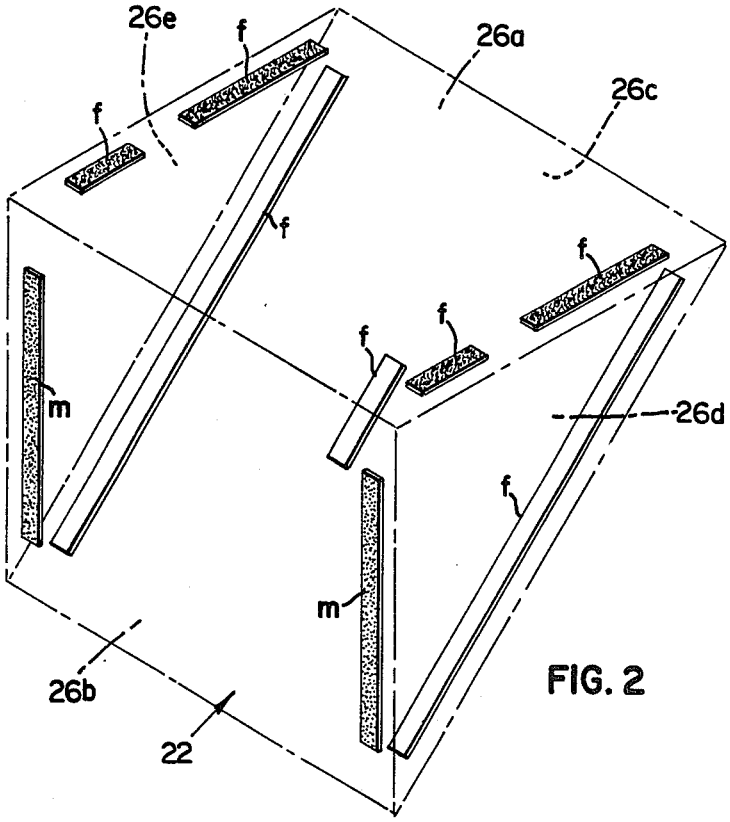
FIG. 2 is a perspective view of a first resilient support element of the system of FIG. 1.

With reference to the Drawing, wherein like reference numerals designate like parts and assemblies throughout the several views, FIG. 1 illustrates, in side elevation, back support system 20 in its "compact" or "assembled" state. The system 20 includes four resilient elements or pillows made from medium-density foam or the like. Included are a relatively large wedge-shaped pillow 22 and a smaller wedge-shaped pillow 24. As can be seen in FIGS. 1 and 2, wedge pillow 22 has the cross-section of a right isosceles triangle. The perpendicular sides of large wedge pillow 22 are designated 26*a* and 26*b;* the hypotenuse side of the wedge pillow 22 is labeled with reference numeral 26*c*. Wedge pillow 22 also includes end pieces 26*d* and 26*e* in the shape of right isosceles triangles. In one embodiment, the sides 26*a* and 26*b* are preferably approximately 20 inches long, and the hypotenuse side 26*c* is accordingly approximately 28 inches long. The width of the wedge pillow 22 is preferably approximately 23 inches long. The dimensions of the pillows can be varied to accommodate a large spectrum of patients.

Smaller wedge pillow 24 also has a cross-section which approximates a right isosceles triangle. The orthogonal sides are designated 28*a* and 28*b* and the hypotenuse side is designated 28*c* and the substantially triangular ends are labeled 28*d* and 28*e* in the Drawing. As shown in FIG. 1, smaller wedge pillow 24 does not have a cross-section which is precisely a triangle, however. Side 28*b* includes a concave area 30 which is approximately 4½ inches long (measured along the curvature) and has a radius of curvature of approximately 10 inches. The other side 28*a* and the hypotenuse 28*c* of smaller wedge pillow 24 are planar, however. The sides 28*a* and 28*b* are preferably approximately 17½ inches long, and the hypotenuse side 28*c* is therefore approximately 25 inches long. As the pillows 22 and 24 have cross-sections of right isosceles triangles, or nearly so, the angles between the short sides 26*a,b* and 28*a,b* and the hypotenuse sides 26*c* and 28*c* are approximately 45 degress. The width of pillow 24 is the same as the width of pillow 22.

The third resilient element is a cervical pillow 32. As shown in FIG. 1, the cross-section of the cervical pillow 32 is substantially trapezoidal having a bottom 34*a*, a pair of sides 34*b* and 34*c*, a top 34*d*, and ends 34*e* and 34*f*. Side 34*c* is substantially perpendicular to top 34*d* and bottom 34*a*, whereas side 34*b* preferably forms an acute angle with bottom 34*a* which is substantially equal to the angle formed by side 26*b* and hypotenuse side 26*c* of wedge pillow 22, i.e., 45 degrees. Also, one end of top 34*d* of cervical pillow 32 forms a convex area 36 which has a radius of curvature and length substantially equal to the radius of curvature and length of concave section 30 of small wedge-shaped pillow 22. The concave and convex sections 30 and 36, respectively, are located such that they mesh when the unit 20 is assembled into its block form as shown in FIG. 1. The length of bottom 34*a* is substantially equal to the length of side 26*a* of wedge pillow 22.

The fourth and last pillow 38 of unit 20 is in the form of a rectangular block or parallelepiped having parallel sides 40*a* and 40*b*, parallel top and bottom 40*c* and 40*d*, and parallel ends 40*e* and 40*f*. The lengths of the top and bottom 40*c* and 40*d* are preferably equal to the lengths of the bottom of the cervical pillow 32 and of the side 26*a* of wedge pillow 22. The height or thickness of block 38 is preferably approximately 4 inches. The function of block 38, described below, dictates its preferred height. The width of pillow 38 is equal to that of the other pillows.

Resilient elements 22, 24, 32 and 38 are preferably made from medium-density polyurethane foam and are covered with nylon or cloth using conventional techniques. Of course, resilient elements 22, 24, 32 and 38 could be fabricated from other materials using other techniques, and the invention is not limited to the preferred materials and techniques described above. In addition, the invention is not limited to pillows having the precise cross-sectional configurations shown in FIG. 1.

The resilient elements 22, 24, 32 and 38, as discussed above, are preferably covered with nylon or cloth. On the outside surface of the covers are hook-and-loop strips which are positioned so as to hold the resilient elements 22, 24, 32 and 38 in various preferred configurations shown in FIGS. 7–14. Velcro TM strips are preferably used. Hook or "male" Velcro TM strips, as is well-known, have an abundance of small gripping protrusions which adhere readily to loop or "female" Velcro TM strips.

Figures 3, 4, 5:
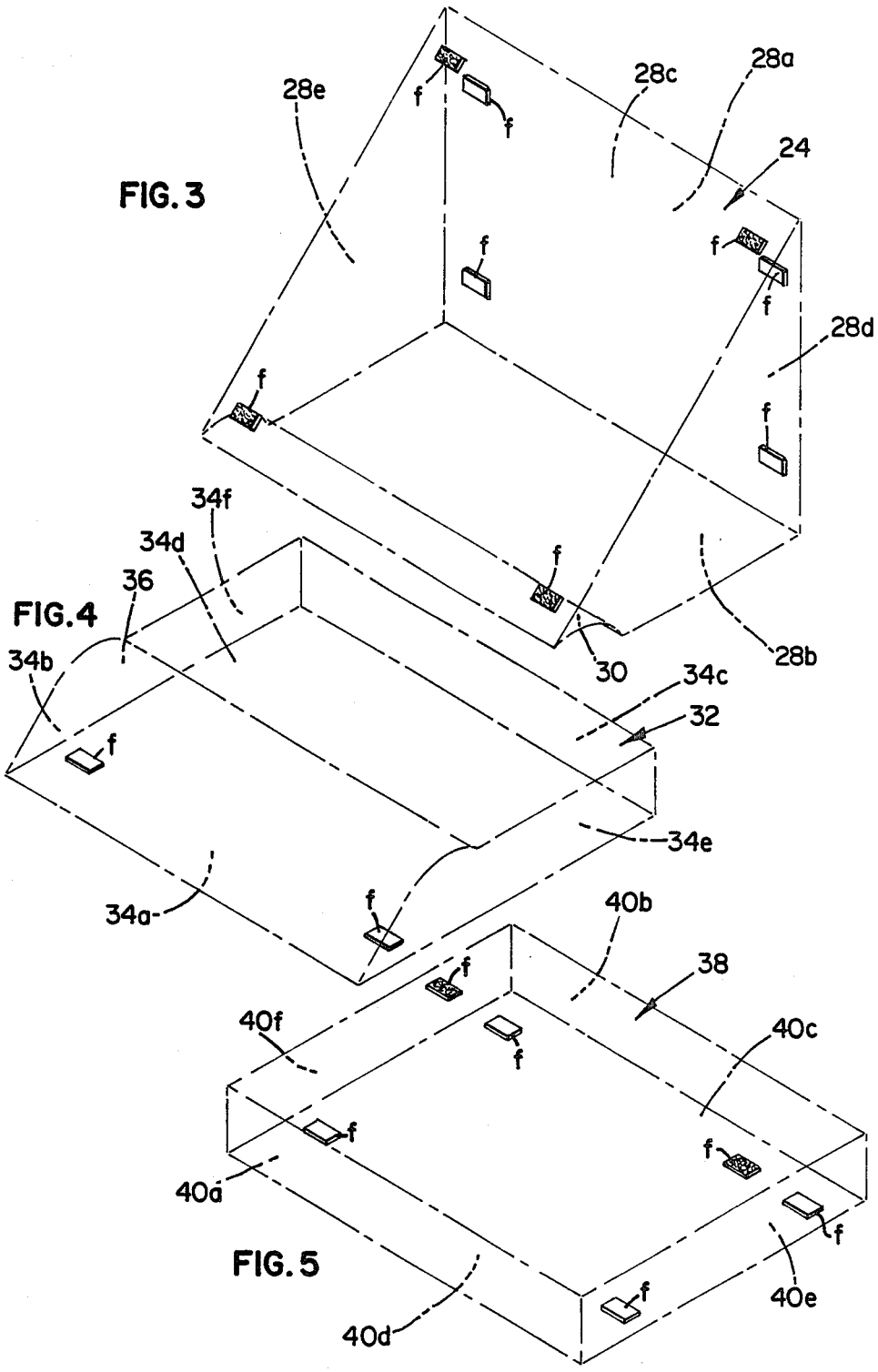
FIG. 3 is a perspective view of a second resilient support element of the system of FIG. 1.
FIG. 4 is a perspective view of a third resilient support element of the system of FIG. 1.
FIG. 5 is a perspective view of a fourth resilient support element of the system of FIG. 1.

FIG. 2 shows a perspective view of large wedge pillow 22, illustrating the preferred positioning of Velcro TM strips thereon. Male Velcro TM strips are designated with the small letter "m", while female Velcro TM strips are designated with the small letter "f". Similarly, FIGS. 3–5 show the preferred placement of Velcro198 strips on the remaining pillows of unit 20.

In addition to the Velcro TM strips, metal rings 22*a*, 22*b* and 24*a*, 24*b* are respectively mounted to the sides 26*d*, 26*e* and 28*d*, 28*e* of pillows 22 and 24. Rings 22*a* and 24*a* are used in conjunction with a Velcro TM covered strap 46 to adjustably couple the triangular pillows 22 and 24 as shown in FIGS. 7 through 14. The pillows 22 and 24 are positioned appropriately, then one strap 46 is fed through one set of rings and overlapped for engagement, and the other strap 46 is fed through the outer set of rings and overlapped for Velcro TM engagement. As shown in FIGS. 7–14, in some cases ring 22*a* is connected to ring 24*a*, but in other cases ring 22*a* is connected to ring 24*b*.

Figure 6:
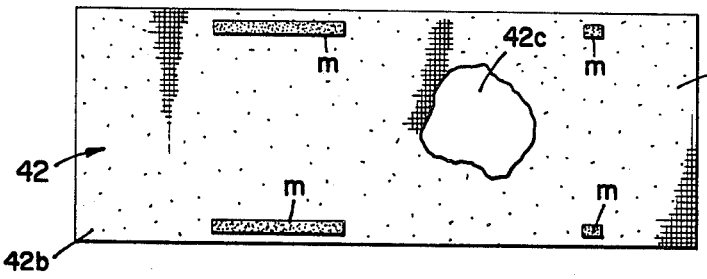
FIG. 6 is a top plan view of a mat for use in conjunction with the resilient support elements of FIGS. 2–5.

FIG. 6 shows a top plan view of a mat 42 which can be used in conjunction with the pillows 22, 24, 32 and 38. Mat 42 also preferably includes Velcro TM strips positioned as shown in FIG. 6. The width of mat 42 is preferably substantially equal to the width of pillows 22, 24, 32 and 38, whereas the length of mat 42 can be any convenient length suitable for accommodating the pillows 22, 24 32 and 38 in the configurations shown in the remaining Figures.

It should be noted that there are other means for interconnecting the pillows 22, 24, 32 and 38, and the invention is not limited to Velcro TM by any means. For example, certain weaves of upholstery material will cohere to itself, eliminating the need for "male" and "female" strips.

Figure 7:
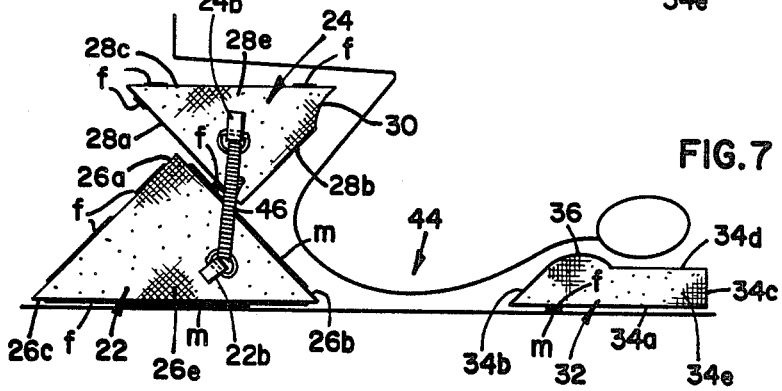

FIGS. 7–14 show various preferred uses of pillows 22, 24, 32 and 38 and mat 42. FIG. 7 shows one way to utilize the unit 20. The hypotenuse 26*c* of large wedge-shaped pillow 22 is placed downward on the mat 42 and the side 26*b* of large pillow 22 engages and supports the planar area 28*a* of smaller wedge-shaped pillow 24. Velcro TM covered straps 46 are threaded through rings 22*a,b* and 24*a,b* and draw the pillows 22,24 together in this configuration. The hypotenuse side 28*c* is thus positioned upward and is substantially horizontal. The cervical pillow 32 is located at an appropriate distance from the assembled pillows 22 and 24 such that the convex area 36 of the pillow 32 can support the individual's neck and the planar area 34*d* can support the individual's head. The angle between the individual's middle back and upper legs is therefore approximately 90° and the angle between his upper and lower legs is 45°, with his lower legs supported in a horizontal position. The individual's lower back is curved to a fairly drastic extent in a direction opposite from the normal lumbar curve. This configuration would be appropriate for someone suffering from disc displacement or vertebrae misalignment. Causing such a lower back curve relieves pressure on the nerves and the associated pain. It should be noted that in this configuration the buttocks of the individual 44 is supported to some degree by the large pillow 22.

Figure 8:
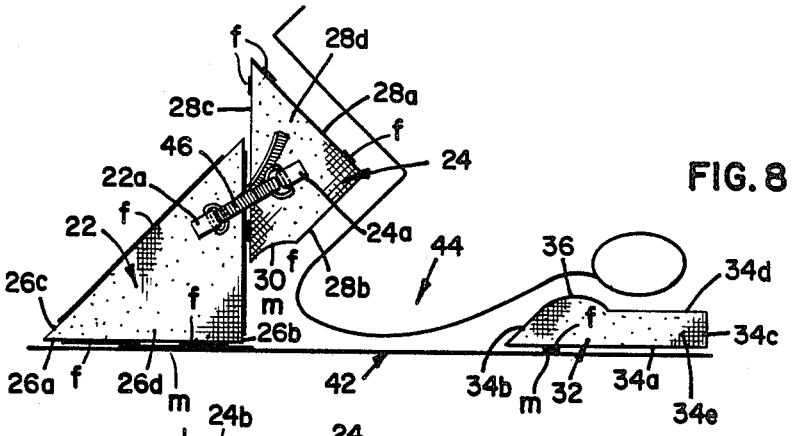
FIGS. 7 through 14, inclusive, show diagrammatic side elevational views of the components of the back support system of FIG. 1 in various configurations.

FIG. 8 shows a second way to utilize the unit 20. The large wedge-shaped pillow 22 is positioned with its side 26*a* in operative contact with mat 42, the Velcro TM strips "m" and "f" holding them together. The hypotenuse 28*c* of smaller wedge-shaped pillow 24 is in gripping contact with the remaining side 26*b* of large pillow 22. The Velcro TM straps 46 thread through the rings 22*a,b*, and 24*a,b* to pillows 22,24 together and allow for their adjustment. Cervical pillow 32 is located a distance from the assembled pillows 22 and 24. An individual 44, shown very diagrammatically in the Drawing, uses the assembled pillows 22, 24 and 32 and mat 42 by resting his head on the cervical pillow 32 with the convex section 36 thereof supporting his neck. The upper and lower legs of the individual 44 are supported as shown so as to curve the lumbar region of the individual's back in an orthopedically sound fashion. Of course, it is preferable that a trained individual such as a chiropractor be consulted as to the placement of pillows 22, 24 and 32 and mat 42 to maximize their effectiveness and minimize any risk of harm to the individual 44. The configuration of FIG. 8 places the user's upper and lower legs in a perpendicular relationship and draws the individual's upper legs near his torso. As compared to the configuration of FIG. 7, a less drastic curve in the lumbar region of the individual's spine is thereby effected. This configuration would therefore be appropriate for someone experiencing less misalignment or nerve pinching. In fact, the configurations pictured in FIGS. 7 through 12 are given in order of severity of condition. That is, the configuration of FIG. 7 is appropriate for someone in a lot of pain, whereas the configuration of FIG. 8 is for someone who is not suffering as much subluxation, i.e., pressure on nerves, and so on.

Figure 9:
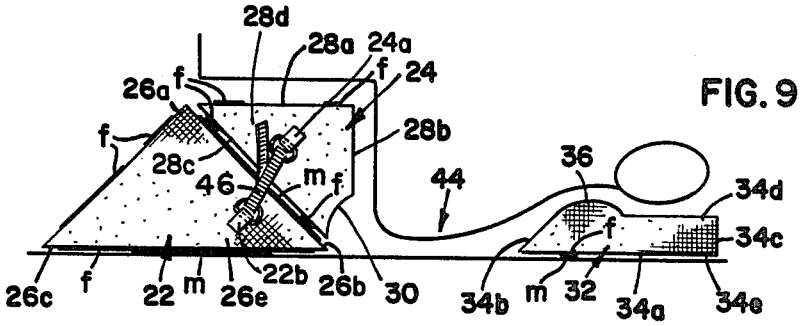

FIG. 9 shows a third assembled configuration. The large wedge-shaped pillow 22 and cervical pillow 32 are positioned as they were in FIG. 7. In this case, however, the hypotenuse side 28*c* of smaller wedge-shaped pillow 24 is placed in contact with the side 26*b* of large pillow 22 which is proximate the cervical pillow 32. Since the wedge pillows have cross-sections of right isosceles triangles, or nearly so, this places the side 28*a* of smaller wedge-shaped pillow 24 in a substantially horizontal position and places the opposite side 28*b* of pillow 24 in a substantially vertical position. Thus, the individual's upper legs are held substantially vertically while the individual's lower legs are supported in a horizontal fashion. This results in less curvature of the lumbar region than was created by the configurations shown in FIGS. 7 and 8.

Figure 10:
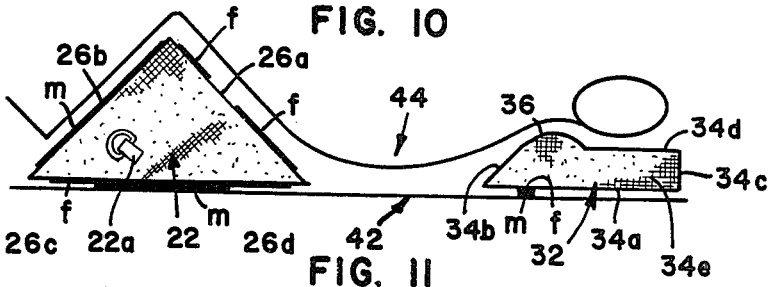

FIG. 10 shows a fourth possibility. In this case, the smaller wedge-shaped pillow 24 is removed, but the pillows 22 and 32 are positioned substantially as they were in the configurations shown in FIGS. 7 and 9. Thus, the cervical pillow 32 supports the individual's neck and head while the sides 26*a* and 26*b* of large wedge-shaped pillow 22 support the individual's upper and lower legs, respectively, such that the angle between the torso and upper legs is approximately 135° and the angle between the upper and lower legs is 90°. As can be seen, this configuration is less drastic in terms of curving the individual's lower back. In view of this, this configuration would be appropriate for treating less severe misalignments, for example.

Figure 11:
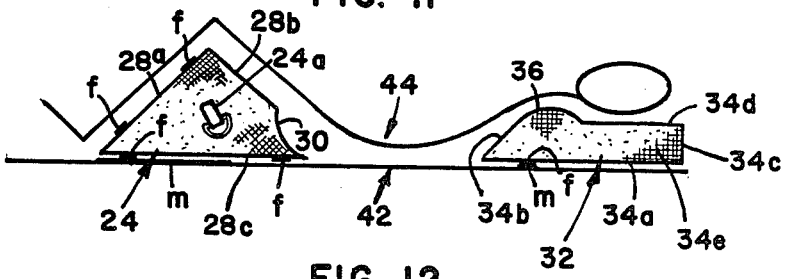

The arrangement shown in FIG. 11 is identical to that shown in FIG. 10 except that the smaller wedge-shaped pillow 24 is used in lieu of the larger wedge-shaped pillow 22. A smaller person would probably use the smaller wedge pillow 24 rather than the larger wedge pillow 22. Of course, pillow 24 could be reversed so that its planar side 28*a* is supporting the individual's upper legs.

Figure 12:
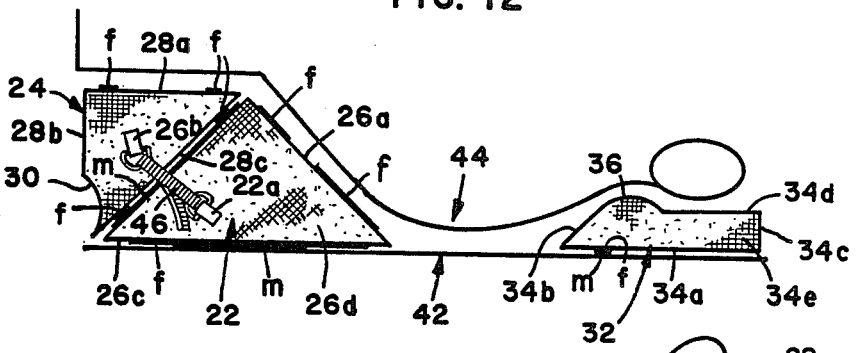

FIG. 12 shows a configuration which is similar to that shown in FIG. 9 except that the smaller wedge-shaped pillow 24 is positioned on the side 26*b* of the large pillow 22 opposite from the cervical pillow 32. In this case, the individual's upper legs are supported by side 26*a* of large pillow 22 while the individual's lower legs are supported by side 28*a* of smaller wedge-shaped pillow 24. Thus, the angle between the individual's upper legs and back is approximately equal to 135 degrees and the angle between the individual's upper and lower legs is also approximately equal to 135 degrees.

Figure 13:
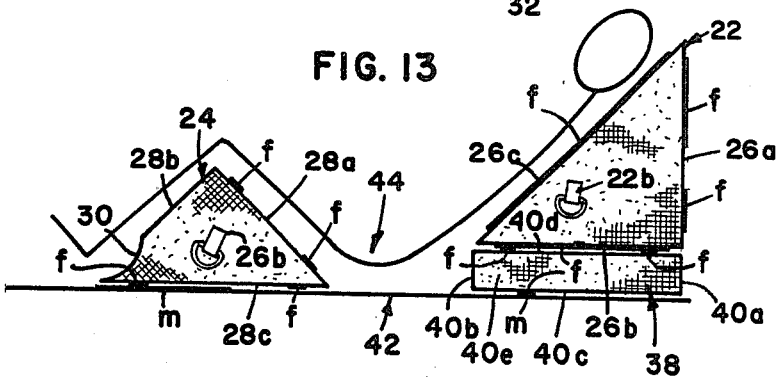

FIG. 13 illustrates how the rectangular block pillow 38 might be used. This configuration also illustrates that the cervical pillow 32 is not necessary in all cases. In this arrangement, the rectangular pillow 38 is placed such that its bottom surface 40*c* is in gripping contact with the mat 42. The top surface 40*d* of rectangular pillow 38 supports the side 26*b* of large wedge-shaped pillow 22 such that the hypotenuse 26*c* of pillow 22 can support the individual's back, neck and head. Wedge-shaped pillow 24 is positioned as it was in the configuration of FIG. 11, with its hypotenuse side 28*c* in contact with the mat 42. The sides 28*a* and 28*b* of wedge-shaped pillow 24 support the upper and lower legs, respectively, of the individual. The angle, therefore, between the individual's upper and lower legs is 90° and the angle between the individual's back and his upper legs is also substantially 90°. As can be seen in FIG. 13, this configuration tends to support the individual's back, and most people, even if they do not suffer from a back ailment, would find this position restful for reading or for television viewing, for example. The configuration shown in FIG. 13 would also be appropriate for individuals who have relatively long upper bodies.

Figure 14:
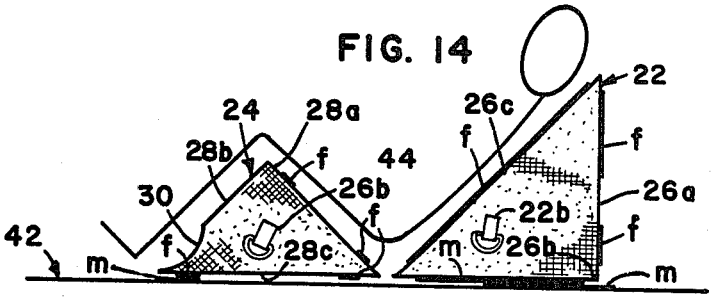

The configuration of FIG. 14 is much like that of FIG. 13 except that rectangular pillow 38 is removed and wedge-shaped pillows 22 and 24 are placed end-to-end, or nearly so. Thus, the individual's upper and lower legs are substantially perpendicular, and the individual's back and upper legs are orthogonal, also. The primary difference between the configurations of FIGS. 13 and 14 is that in FIG. 13 the individual's buttocks is supported to some degree by the mat 42. By contrast, the individual's entire back and buttocks are supported by pillows 22 and 24 using the arrangement of FIG. 14. This configuration would be most useful for someone who wishes to sit upright in bed.

Following use of the pillows 22, 24, 32 and 38 and mat 42, the pillows can be reconstructed into their assembled state as shown in FIG. 1. With the exception of the cervical pillow, the Velcro TM strips attached to the pillows hold them in the cube storage shape shown in FIG. 1. The assembled pillows 22, 24, 32 and 38 and the mat 42 and straps 46 can then be inserted into a cloth or nylon bag for storage or transportation. Of particular importance is the fact that the pillows 22, 24, 32 and 38 combine to form a geometrical solid (e.g., cube shown in FIG. 1) which is compact and which can itself be used as an ottoman, a chair or a stool. Individual cervical and leg pillows of the prior art, by contrast, are typically stored in a closet between uses as they are not components of a system which can assemble into an integral, compact solid suitable for use as a useful piece of furniture.

It should be emphasized that the present invention is not limited to any particular components, materials or configurations, and modifications of the invention will be apparent to those skilled in the art in light of the foregoing description. This description is intended to provide specific examples of individual embodiments which clearly disclose the present invention. Acccordingly, the invention is not limited to these embodiments or to the use of elements having the specific configurations and shapes as presented herein. All alternative modifications and variations of the present invention which fall within the spirit and broad scope of the appended claims are included.

I claim:

1. An apparatus for providing back and neck support to an individual comprising: plurality of pillows which fit together in a storage position to form a rectangular solid and can be removed from the storage position for use to provide back and neck support, said pillows comprising:

(a) a cervical pillow shaped and configured to support the individual's neck and head;

(b) a first wedge-shaped pillow having a right triangular cross section with two perpendicular sides and a hypotenuse side, the perpendicular sides and the hypotenuse side each having adjustable hook and loop connector means thereon;

(c) a second wedge-shaped pillow having a substantially right triangular cross section with two perpendicular sides and a hypotenuse side, one perpendicular side and the hypotenuse side each having adjustable hook and loop connector means thereon;

(d) a mat at least three feet in length; and (e) adjustable hook and loop connector means for connecting the cervical and first and second wedge-shaped pillows to the mat, wherein at least one of the wedge-shaped pillows can be adjustably connected to the mat to support the individual's upper and lower legs and the pillows fit together to form a geometrical solid for storage and transportation.

2. The apparatus of claim 1, wherein the hook and loop connectors are Velcro TM strips.

3. The apparatus of claim 2, wherein the geometrical solid is a cube.

4. The apparatus of claim 1, further comprising a parallelepiped elevation pillow suitable for elevating at least one of the wedge-shaped pillows off of the mat.

5. The apparatus of claim 1, wherein the pillows are formed from medium density foam.

6. The apparatus of claim 5, wherein the medium density foam is polyurethane foam.

7. The apparatus of claim 6, wherein the foam is covered with nylon.

8. The apparatus of claim 1, wherein the right triangular cross-sections are isosceles right triangular cross-sections.

* * * * *